US010495425B1

(12) United States Patent
Shebalin

(10) Patent No.: US 10,495,425 B1
(45) Date of Patent: Dec. 3, 2019

(54) THERMOFORMED PROJECTILE CARTRIDGE

(71) Applicant: John-Paul Shebalin, Chapel Hill, NC (US)

(72) Inventor: John-Paul Shebalin, Chapel Hill, NC (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 16/151,638

(22) Filed: Oct. 4, 2018

(51) Int. Cl.
*F42B 5/00* (2006.01)
*F42B 5/18* (2006.01)
*F42B 5/196* (2006.01)
*F41A 21/16* (2006.01)

(52) U.S. Cl.
CPC ..... *F42B 5/182* (2013.01); *F42B 5/196* (2013.01); *F41A 21/16* (2013.01)

(58) Field of Classification Search
CPC .... F42B 5/02; F42B 5/045; F42B 5/05; F42C 15/34; F41A 19/57; C06C 7/00; E21B 43/116
USPC .. 102/430, 431, 202.14, 231, 275.11, 275.2; 89/1.14
See application file for complete search history.

(56) References Cited

U.S. PATENT DOCUMENTS 2,649,736 A * 8/1953 Phillips ..... E21B 43/116 102/202.14
3,242,864 A * 3/1966 Levy ..... F42B 3/10 102/531
3,446,146 A * 5/1969 Heinz ..... F42B 5/36 102/470
3,648,616 A * 3/1972 Hsu ..... F42B 5/16 102/443
3,695,141 A * 10/1972 Kronman ..... F41F 1/00 89/1.14
3,732,819 A * 5/1973 Quinlan ..... F42B 5/184 102/433
4,664,033 A * 5/1987 Burkdoll ..... C06C 7/00 102/275.11
4,826,637 A * 5/1989 Maures ..... B21D 22/105 264/3.4
5,454,323 A * 10/1995 Conil ..... F42B 5/188 102/282
5,988,039 A * 11/1999 Denchfield ..... F41A 33/04 89/1.14
6,041,712 A * 3/2000 Lyon ..... F42B 5/02 102/439
8,925,463 B1 * 1/2015 Sullivan ..... F42B 39/20 102/439
2004/0069174 A1 * 4/2004 Dorn ..... F41A 19/57 102/437
2004/0074411 A1 * 4/2004 Haeselich ..... F42C 15/34 102/231

(Continued)

*Primary Examiner* — Michael D David
(74) *Attorney, Agent, or Firm* — Gerhard W. Thielman

(57) ABSTRACT

An axisymmetric disk-shaped cartridge is provided for firing from a gun having a fluted bore. The cartridge is initiated by a firing pin and includes a primer core, a propellant charge, a booster charge, a projectile mass, an ablative cap and a ductile metal coating. The projectile mass is disposed over the booster charge while the ablative cap is disposed over the projectile mass. The coating and mass elongate and radially narrow to maintain axial symmetry while being accelerated along the bore.

8 Claims, 2 Drawing Sheets

(56) References Cited

U.S. PATENT DOCUMENTS

| | | | | |
|---|---|---|---|---|
| 2011/0214655 | A1* | 9/2011 | Bakhta | F41B 11/64<br>124/65 |
| 2012/0318123 | A1* | 12/2012 | Worrell | F42B 5/188<br>86/10 |
| 2019/0041181 | A1* | 2/2019 | Little | F42B 39/22 |

* cited by examiner

THERMOFORMED PROJECTILE CARTRIDGE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to bullet cartridges for hand-held guns. In particular, the invention relates to disk cartridges that deform into elongated projectiles during ejection from a tapering gun barrel.

Shortly after World War II (WWII), the U. S. Army studied the capabilities of the infantry rifle, hit probability a function of range, the typical ranges encountered in battle, and the wound effects of hits with differing ballistic characteristics. These studies led to conclusions that:

(1) hit probability with the M1 rifle was satisfactory only up to 100 yards, declining rapidly beyond that;

(2) 300 yards was the range limit for most combat rifle engagements;

(3) a pattern-dispersion principle in the hand weapon could compensate for human aiming errors and increase hit probability within combat ranges; and (4) bullets smaller than 0.30 caliber could be used without loss in wound-effectiveness and with logistical advantage.

Since WWII, the U.S. Army has endeavored to significantly increase the lethality of combat rifles by improving hit probability ($P_h$) and ammunition capacity through innovative rifle designs and ammunition concepts. Initial studies done under the s indicated that rifles of the time were ill-suited to typical combat environments and urged the development of rifles that increased hit probability via controlled bursts. This concept was first pursued by the Army under Salvo and Salvo Squeeze-bore programs used multi-projectile concepts to improve hit probability. Later work included the Special Purpose Individual Weapon program to create a rifle with twice the hit probability of the M14, and later with the Advanced Combat Rifle program's effort to create a rifle with higher hit probability and twice the capacity of the M16. Neither program succeeded.

Later service rifle development shifted away from those goals until the Army's recent Light Small Arms Technologies program's caseless cartridge research. Thus, the Army's service rifle hit probability and capacity requirements remain unmet. Meeting these needs will call for a much lighter, smaller cartridge than the 5.56×45 currently in service. In 1948, the Army's newly-organized Operations Research Office (ORO) studied three million casualty reports from both World Wars during their ALCLAD armor project. The ORO concluded that most combat occurred within a range of 300 yards, with opposing combat teams encountered each other unexpectedly, and those forces with greater firepower tended to win. The ORO also found that hits were often random and that beyond 100 yards marksmanship was reduced by terrain and visibility. Thus time and target exposure were the biggest factors for hit probability, and the main predictor of casualties was the total number of rounds fired.

Influenced by ALCLAD's wound ballistic research, ORO and the Army's Ballistics Research Laboratory (BRL) began a study of combat rifle effectiveness. ORO concluded that infantry should be equipped with a fully-automatic rifle to increase rate-of-fire (ROF), while BRL concluded that a smaller caliber rifle could give greater terminal performance while increasing hit probability at shorter ranges. These conclusions suggest that an ideal service rifle for the US armed forces would be smaller caliber, capable of rapid fire rifle, and with twice the hit probability of existing rifles. The increased hit probability could be achieved either by more accurate fire, or through controlled bursts.

ORO concluded that a rifle designed to provide controllable bursts within a 300-yard range might be preferable to a weapon that provides precise single shots at longer distances. The key was controllability, because an uncontrolled automatic weapon was determined to be no more advantageous than a semi-auto rifle. The ORO projected that a four-round salvo with a 20" spread could double the 300-yd hit probability of a single shot from an M1 rifle. On the downside, such weapons clearly increased ammunition use. Thus in order for a soldier to carry enough ammunition for a firefight, cartridge mass would have to be significantly reduced. The smaller caliber cartridges might also be light enough to enable an equivalent number of fired salvos as compared to the individual cartridge capacity of the M1, making the soldier armed with the smaller caliber twice as effective as when armed with an M1.

Increase in hit probability could be accomplished by controlled bursts. The controlled burst concept led to Project SALVO beginning 1952, which studied the hit probability of multi-shot bursts and later project Salvo Squeeze-bore (SSB) in 1962. Two notable test entries were BRL's modified M2 carbine firing triplex loads from a 0.224 cartridge and 12-gauge shells from the Office of Naval Research (ONR) firing thirty-two steel flechettes. The resulting tests, beginning in June 1956, found that multi-shot loads provided higher hit probability than the M14. However, there remained many engineering problems preventing the multiple loads from becoming practical. The alternative to multi-shot loads were high ROF bursts of single-shot cartridges. A 1961 BRL test demonstrated that 2300-rpm bursts increased hit probability by 10% to 270% over a similar length full-auto burst from an M14. Both of these options would continue to be pursued under later projects described subsequently.

Concurrent with Project Salvo, a commercial 5.56×45 mm rifle was being developed by Armalite Corporation, influenced by the ORO and BRL rifle effectiveness studies. In 1958 the Army found that the lighter and smaller AR-15 could be brought to bear quicker than other existing rifles, concluding that an eight-man team with AR-15's would have the same firepower as an eleven-man team armed with the M14. After a successful 1960 demonstration of the AR-15, the Strategic Air Command ordered 8,500 AR-15s. The Advanced Research Projects Agency bought a thousand more AR-15s—now called the M16—for South Vietnamese troops in 1962.

American soldiers and advisors working with the South Vietnamese encouraged use of the M16 by U.S. soldiers. As a replacement for the M1 and M14 was needed, and because the research and development (R&D) for such a replacement remained underway, the M16 was the best option available. The M16 did not meet the capabilities requirements for hit probability and burst rate first identified in Army rifle requirements studies of the 1950's. The pursuit of this capability would continue under future projects until 1992 and again in the current Light Small Arms Technology (LSAT) program.

Since 1952, the U.S. Army has conducted a series of R&D programs with the goal of creating an infantry rifle with higher hit probability and ammunition capacity than the M14 and M1 rifles available fifty years ago. This research was initiated by several post-World War II studies, which indicated that the rifles used exhibited inadequate hit probability for the battlefield environments actually encountered. The inadequacies of existing rifle technology could be mitigated by using automatic burst-capable rifles designed to provide improved hit probability while being light enough to carry. This was confirmed by Project Salvo (1952-1962), which investigated multi-shot bursts and their effect on hit probability. By 1962, the M16—firing the 5.56×45 cartridge—has been adopted as the standard U.S. service rifle, replacing the M14.

The 5.56×45 cartridge is rimless bottlenecked standard cartridge for North Atlantic Treaty Organization (NATO) countries, and derives from the 0.223 Remington cartridge. The 5.56×45 cartridge has a total length of 5.74 cm firing a projectile having a diameter of 0.57 cm and a length of 1.21 cm. The 5.56×45 cartridge with 62 grains has a mass of 4.0 grams. However, because the M16's three-round bursts did not provide a close enough shot distribution for increased hit probability, the M16 did not satisfy the requirements of the original research programs that brought about the development of an improved battle rifle in the first place.

With the results from Projects Salvo and Squeeze-bore, the Army conducted the Special Purpose Individual Weapon (SPIW) program (1962-1973) with the objective of developing a rifle with twice the hit probability of the M14. Although the SPIW program ended unsuccessfully some promising concepts from this program, which were further developed under follow-on programs, including the Future Rifle Program (FRP) and Future Rifle Systems (FRS) programs. Later the Advanced Combat Rifle (ACR) Program (1987-1992) picked up where the SPIW program left off, seeking to double the hit probability and ammunition capacity of the M16, which had been adopted just at the opening of the SPIW program for the Advanced Combat Rifle (ACR). However, none of the entries met the program's performance requirements, likely due to the hit physical limitations of the brass-cased cartridge paradigm. Thus, the guidelines laid out early on by ORO the SPIW program and pursued up through the ACR program-guidelines detailing real needs of the Army-remain unmet.

In 1961 the Army's Combat Development Experimentation Command (CDEC) published the study "Optimum Composition of the Rifle Squad & Platoon", which suggested that members of a squad should be armed with flechette rifles. In 1962, based on CDEC's report, the Ordnance Corps began the Special Purpose Individual Weapon (SPIW) program to develop an automatic rifle carrying sixty flechettes and three grenades while weighing under 10-lb per soldier-load. By February 1963, Phase I contracts were awarded to Aircraft Armaments Inc., (AAI), Springfield Armory, Harrington & Richardson (H&R), and Winchester.

The prototypes submitted by AAI, Springfield, and Winchester all used specially designed saboted single-flechette cartridges, while and H&R used a saboted triplex cartridge of its own design. Ultimately, all four entries were deemed too heavy, too complicated, or unreliable for further development. After an unsuccessful Phase I, the SPIW program continued with the Serial Flechette Rifle project. In February 1967, AAI was funded by BRL to improve their SPIW flechette rifle. By November 1967, however, the preexisting issue of rapid heating resulted in actual occurrences of cartridge cook-offs (earlier prototypes were not fired long enough to for cook-off to occur). Thus AAI turned their focus on to eliminating the cook-off problem, which was eventually achieved.

The pursuit of a combat rifle meeting the performance levels laid out originally for Project SALVO continued throughout the 1960's and 1970's. In 1969 the FRP sought to further develop AAI's flechette rifle, with a focus on multiple flechettes per cartridge. Springfield Armory's SPIW design was also pursued. However, by December 1973, flechette ammunition was removed altogether from "immediate consideration" in the upcoming FRS Program, due to problems with the sabot cartridge.

In 1988, the Army began the Advanced Combat Rifle (ACR) program to produce a service rifle with the loftier goal of doubling the hit probability and ammunition capacity available in the now standard M16, which had a hit probability of 20% at 100 meters (m), 10% at 300 m, and 5% at 600 m. This was a tighter requirement then that of the old SPIW program which sought to improve on the older M14 while maintaining a per-soldier load of under 10-lb. Four contracts were awarded for the ACR program: AAI, Heckler & Koch (H&K), Steyr, and Colt. Ultimately, none of the entries offered a large enough capacity or enough of a hit probability increase over the M16A2 to warrant further development or adoption. After the ACR program ended in 1992, service rifle development work shifted from efforts to double hit probability and ammunition capacity to focus on indirect fire systems. In 1993, the Army initiated the Objective Individual Combat Weapon (OICW) to develop a rifle capable of attacking targets behind cover by using airburst munitions.

The OICW program's focus was refined to a combination of a short assault and semi-automatic, low-velocity 20 mm-to-25 mm cannon firing air-bursting munitions. The winner of the OICW contract was the Alliant Techsystems XM29, which included an advanced programmable 20 mm grenade launcher, but was based on an existing rifle design firing the 5.56×45 cartridge. The OICW program was cancelled and the XM29 shelved in 2004, while the rifle portion of the XM29 was continued as the XM8 program until cancelled in October 2005. The efforts to produce a rifle with double the hit probability and ammunition capacity of the M16 and previous rifles remain unsuccessful.

The most advanced cartridge technologies under active development are the caseless and plastic-cased "telescoping cartridges" of the Lightweight Small Arms Technology (LSAT) program at the Army Research Development and Engineering Center (ARDEC). The goal of this program is a 50% reduction in mass and 40% reduction in volume per cartridge, relative to the 5.56×45 SS109 and M855 cartridges. The LSAT Program is pursuing two cartridge designs-a polymer-cased telescoped round by ARES and a caseless round (by ATK) based on HK G11 technology. This program is also developing a larger caseless cartridge for use in a potential machinegun replacement for both 5.56×45 and 7.62×51 caliber machine guns. The goal of the machine gun effort is to produce a machine gun with the weight of the 5.56 mm while maintaining the effectiveness of the 7.62×51 cartridge.

The state of the art as relates to combat rifles and ammunition is represented by those developed most recently in the ACR program—primarily the H&K G11 rifle and its 4.7×33 caseless cartridge, and secondarily the Steyr ACR's plastic-cased flechette cartridges. The H&K 4.7×33 caseless cartridge represents the state of the art with respect to caseless ammunition and solid propellants, and is capable of withstanding 100° C. higher chamber temperatures before "cook-off". This results in a round that has been incorporated into a light machinegun design rated for 300-rounds before overheating. This rifle also appears to most closely approach the requirements for the necessary burst speeds and ammunition capacity, firing 2000-rpm three-round delayed-recoil bursts from a 45-round magazine.

However, the burst rate falls short of the 2400-rpm rate indicated in "Operational Requirements for an Infantry Hand Weapon" and the magazine capacity still falls short of the 60-rounds specified by the ACR program requirements. The Steyr ACR flechette cartridges were also very low mass, with the added advantage of velocities as high as 1500-m/s a flattened trajectory, and long range due to the low drag of the flechette. The Steyr ACR cartridges achieved low mass not by eliminating the case, as with the G11, but by using a polymer case and by using a very light 10-grain projectile.

Another recent innovative development in small arms ammunition is a superposed load system by Metal Storm Ltd. of Brisbane, Australia, capable of firing 30,000-rpm bursts from a single barrel. This system involved multiple cartridges loaded in a single barrel (eliminating the magazine and action) and fired, electronically one at a time. Such a system enables extremely high rate-of-fire bursts as well as individual shots. This system, however, does not enable high ammunition capacity through low per-round weight and is thus better suited for specialized applications, such as less-than-lethal weapons, grenade launchers, and closein-defense weapons. However, because the Metal Storm system relies on larger ammunition and is limited to the space within the barrel—or barrels—Metal Storm will likely lack the operating characteristics and ammunition capacity required for service rifles.

Two notable innovations, flechettes and caseless propellants, provide incremental advantages, but have thus far fallen short of meeting U.S. military requirements. While caseless cartridges reduce mass and increase firing rate by eliminating the metallic case, they have not sufficiently increased hit probability and capacity, and have also raised durability concerns due to the exposed propellant. Flechettes achieve high velocity with low recoil and low mass due to lighter projectiles, but have been plagued by cost and safety concerns. The challenge is to draw on these concepts such that their individual pitfalls are avoided.

SUMMARY

Conventional ammunition cartridges yield disadvantages addressed by various exemplary embodiments of the present invention. In particular, various exemplary embodiments provide an axisymmetric disk-shaped cartridge for firing from a gun having a fluted bore. The cartridge is initiated by a firing pin and includes a primer core, a propellant charge, a booster charge, a projectile mass, an ablative cap and a ductile metal coating. The core initiates in response to being struck by the firing pin. The propellant charge annularly envelopes the core separated by an annular gap. The booster charge is disposed over the propellant charge and within the annular gap.

The booster charge initiates in response to the core. The propellant charge initiates in response to the booster charge. The projectile mass is disposed over booster charge. The ablative cap is disposed over said projectile mass. The ductile metal coating covers over the ablative cap, and around and under the propellant charge and core. The coating and mass elongate and radially narrow to maintain axial symmetry while being accelerated along the bore.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in centimeters (cm), mass in grams (g), time in seconds (s), and rotations in revolutions-per-minute (rpm). Supplemental measures can be derived from these, such as density in grams-per-cubic-centimeters ($g/cm^3$), moment of inertia in gram-square-centimeters ($g\text{-}cm^2$) and the like.

In order to effectively double the hit probability and ammunition capacity of existing 5.56×45-based rifles, an exemplary cartridge of under half the mass of the 5.56×45 is needed, while being compact enough to enable high enough cyclic rates (>2300-rpm) to provide salvo bursts for increased hit probability. Exemplary embodiments describe such a projectile cartridge for gun launch.

This disclosure describes the exemplary thermoformed projectile (TFP) cartridge concept to combat rifle design. The TFP cartridge design results from efforts to incorporate existing technologies to develop a cartridge of minimal size and mass for a given lethality. The exemplary design shows the potential for multifold reductions in size and mass relative to existing technologies, thus increasing firepower, hit probability ($P_h$), and the amount of ammunition a soldier can carry. The TPC's design and function are described herein in the context of application to a soldier combat weapon, including the history of earlier efforts with similar aims.

Figure 1:
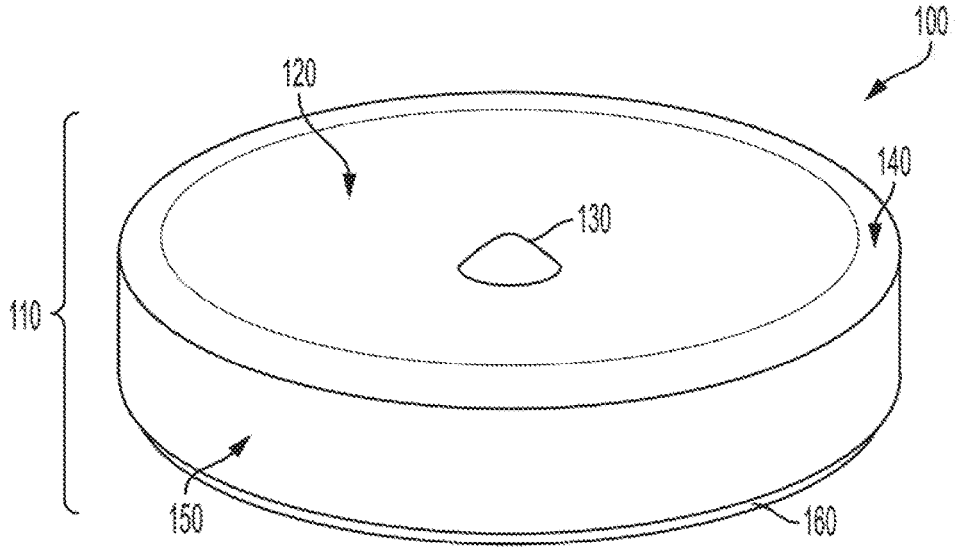
FIG. 1 is a perspective view of an exemplary cartridge.

FIG. 1 shows a perspective view 100 of an exemplary thermoformed projectile cartridge (TPC) round 110. The obverse face includes a convex upper surface 120 with a center nipple 130. The outer rim includes an upper chamfer 140 and a cylindrical sidewall 150. The reverse side features a flat lower surface 160. The TPC 110 is substantially shaped as an axisymmetric disk or with a low aspect ratio (thickness-to-diameter), analogous to the shape of a hockey puck.

A TPC round 110 of 5.56×45 caliber, would correspond to a diameter of 2.06 cm and a thickness of 0.5 cm, with a total mass of 1.0 gram.

Figure 2A:
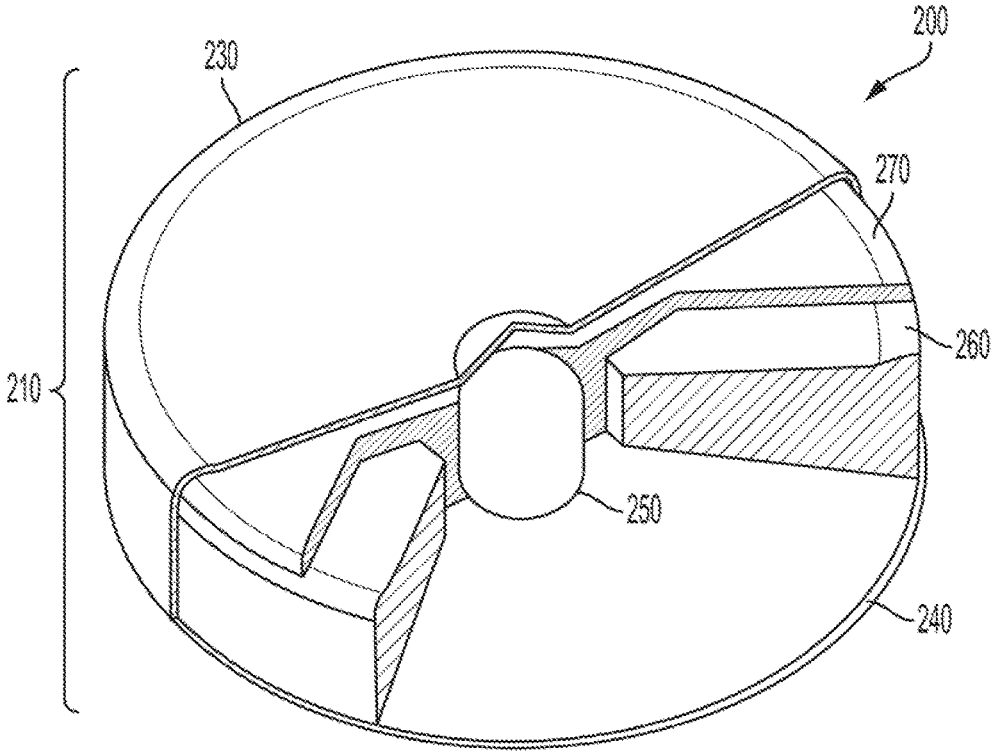
FIGS. 2A and 2B are perspective cross-section views of cartridges.
Figure 2B:
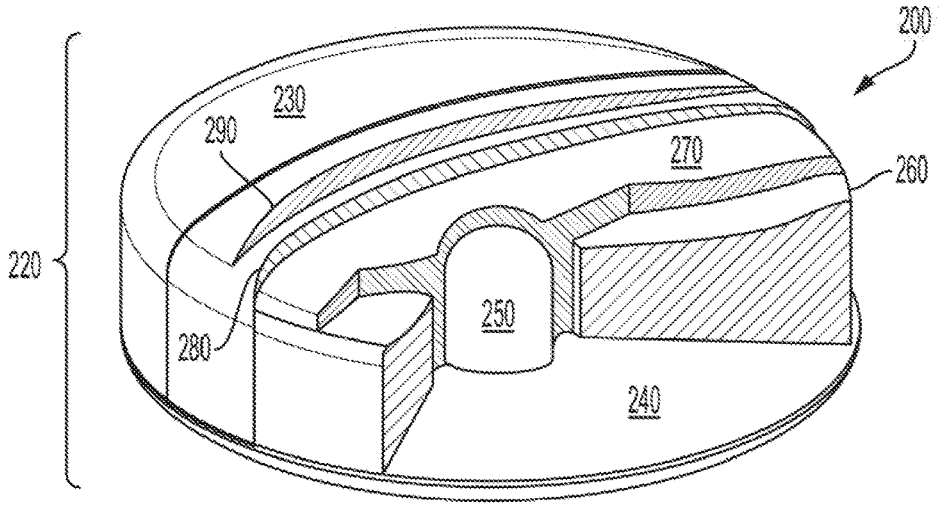

FIGS. 2A and 2B show perspective cutaway views 200 of exemplary cartridge designs 210 and 220 respectively. The nipple configuration for TPC round 110 corresponds to the cutaway cartridge 210. An upper external layer 230 provides a protective metal coating for the obverse surface 120 and the rim surfaces 140 and 150. A lower external layer 240 provides a protective metal coating for the reverse surface 160. The layers 230 and 240 are typically composed of a ductile metal, such as copper (Cu). The primer charge 250 contains 15 grains for the 5.56×45 caliber.

A dome-capped primer 250 at the core is disposed at the axial center of the cutaway cartridges 210 and 220 below the nipple 130 and within the volume contained by the external layers 230 and 240. An annular propellant charge 260 radially surrounds the primer 250, separated by a radial gap. A booster charge 270 fills the gap and is disposed over the propellant charge 260. The second cartridge 220 illustrates a projectile mass 280 over the booster charge 270 and an ablative cap 290 over the projectile mass 280. The first cartridge 210 illustrates an unspecified space denoting the mass 280 and cap 290 between the booster charge 270 and the upper external layer 230.

Upon initiation, the primer 250 initiates the booster charge 270, which initiates the propellant charge 260. These initiations expand the volume within the external layers 230 and 240 and facilitate elongation along the axis while reducing the radial extent, while traveling along the narrowing bore of the gun. The ablative cap 280 disintegrates to reduce friction under acceleration along the bore.

Figure 3:
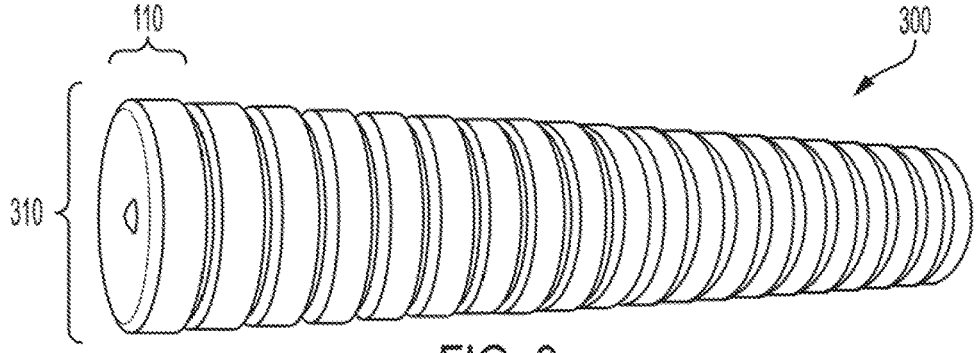
FIG. 3 is a perspective view of a stack of cartridges.

FIG. 3 shows a perspective view 300 of a stack 310 of twenty TPC rounds 110. Such stacking enables a large number of cartridges to be contained within a magazine with minimal wasted volume. The stack 310 has a total length of about 10.5 cm.

Figure 4:
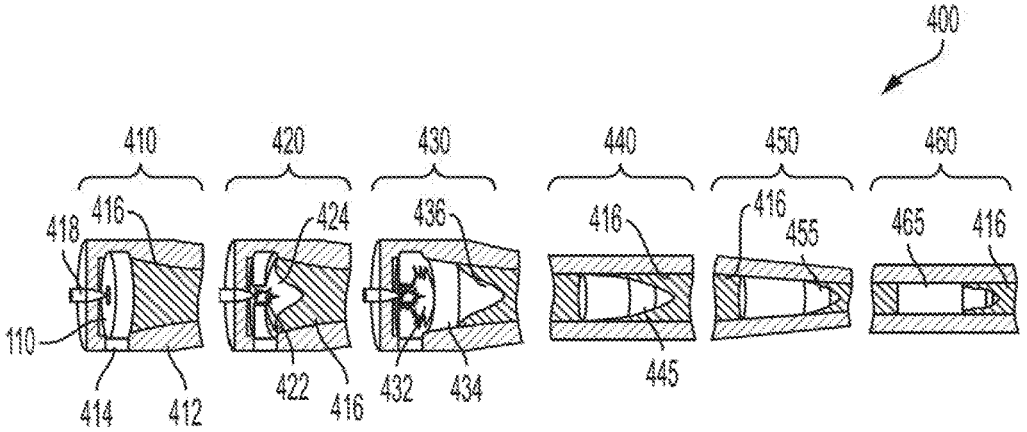
FIG. 4 is an elevation view of an event sequence for cartridge firing.

FIG. 4 shows a perspective view 400 of event sequences for firing the cartridge. The first event 410 features a gun barrel 412 having a loading slot 414 at the breech for inserting the TPC round 110 and a tapering bore 416. A firing pin 418 strikes the nipple 130 to initiate firing the TPC round 110. The second event 420 of ignition shows a spark 422 initiated by the pin 418 igniting the primer 250. The spark 422 expands the lower external layer 240 to a Gaussian profile 424 at the fore. The third event 430 of thermoforming shows the spark 422 initiating the propellant charge 260 to produce frustum expansion 434 and elongating the Gaussian expansion 436 from the spark 422.

The fourth event 440 of acceleration shows the bore 416 at an intermediate cylindrical section with the charges 250 and 260 having reshaped the TPC round 110 to a substantially ogive shape 445. The fifth event 450 of swaging shows the bore 416 in a downstream tapering section with the cartridge 110 further elongated in a further ogive shape 455. The sixth event 460 of stabilization shows the bore 416 in a muzzle cylindrical section with the TPC round 110 further compressed with annularly symmetrical folds to a bullet shape 465 for ejection from the barrel 412.

The development of the TPC concept would begin with a feasibility study, followed by a proof of concept and development of the TPC round 110, barrel 412, and ignition system. Development of the TPC's feeding system in the loading slot 414 and rifle platform would follow. The feasibility study will focus on the physics and dynamics involved in the thermoforming of the projectile and the design of the thermoforming chamber. The feasibility study work plan includes manufacturing a test barrel, test projectiles, and propellant charges for firing the test projectiles. These future efforts will include firing the test rounds and exploring the effects of different metal thickness and different pressure profiles on the performance and final shape of the projectile.

Several relatively new technologies provide the means to produce such a cartridge including monolithic high-temperature caseless propellants, blast-formed penetrators, squeeze-bore projectiles, and electronic operation and ignition. By combining these technologies, creating a cartridge with no discarding case, of compact size for improved storage and faster cycling should be possible, and with a fraction of the mass and volume of the 5.56×45 mm cartridge.

The TPC concept is the result of an effort to combine existing technologies and proven concepts to produce a cartridge design of minimum size and mass yet capable of producing extremely high velocity and rate of fire. Although a highly unconventional and untried ammunition concept, if successful, the resulting innovative cartridge could be used in a rifle with several times the ammunition capacity of an M16 while capable of the low recoil and high enough burst rates for significantly increased hit probability. If successfully developed, such a rifle-cartridge combination shows the potential to far exceed requirements set forth by Army R&D programs spanning fifty years.

There also exist two anti-armor technologies that, while not currently used for small arms ammunition, represent concepts that are incorporated into the TPC design. These include squeeze-bore concept used against tanks during the second World War and the currently used explosively formed penetrators (EFP). The tapered-bore systems demonstrate the capability of generating very high muzzle velocities through the use of a tapered barrel permitting high acceleration of a large diameter projectile which is swaged down to a smaller diameter before the projectile leaves the barrel, a concept later adapted for use in the SSB program.

The EFP demonstrates the general feasibility of using thermobaric effects to form an aerodynamic penetrator from a flat plate. Despite the improvements in cartridge technologies and rifle designs discussed in the previously, such developments have fallen short of meeting military or Army requirements in the SPIW, FRP, and ACR research programs. Thus, the U.S. military still does not have a service rifle meeting the requirements initially defined by projects ALCLAD and Salvo in the 1950's. The challenge is to draw on these concepts such that their individual pitfalls are avoided.

While caseless cartridges reduce mass and increase firing rate by eliminating the metallic case, they have not sufficiently increased hit probability and capacity, as most recently demonstrated with the H&K G11 and ACR rifles. Although highly advanced, the 4.7×33 caseless cartridges are not yet compact or light enough to carry the large volume of ammunition needed to increase a soldier's firepower. Likewise, while the advanced delayed recoil system is promising, the 2000-rpm to 2200-rpm firing rate falls short of the 2400-rpm firing rate determined necessary for proper controlled dispersion bursts. Finally, the cartridge's unprotected propellant raises durability concerns.

Flechette cartridges also show significant weight reductions. However, unlike caseless cartridges, there mass is reduced by the use lighter projectiles and, as with Steyr's ACR, plastic cases. While they do not have significant reductions in size, there high velocities, flat trajectories, and low recoil could contribute to increased hit probability bursts. However, these strengths are outweighed by cartridge costs and manufacturability issues. Flechettes achieve high velocity with low recoil and low mass due to lighter projectiles, but have been plagued by cost and safety concerns.

The remaining challenge is to produce a cartridge that is both compact and light enough to permit a design capacity of sixty rounds or more. The exemplary TPC round 110 should be simple enough to be cost effective and to avoid the durability issues of a truly caseless cartridge. While the design of the rifle itself—the firing system—has changed significantly over the past fifty years, the standard cartridge itself has remained relatively unchanged. The hurdle to be overcome now is to leverage the technological advances in propellants, ignition methods, and projectile dynamics into creating a cartridge capable of far surpassing the 5.56×45 mm cartridge in use today.

Satisfying the challenge of producing a cartridge that is durable, light and compact enough for 2400-rpm fire and 60-round capacities, while simple enough to be cost effective, will require a cartridge design that draws on the strengths of the most promising small arms cartridge concepts, while incorporating these strengths and features in such a way that avoids their individual pitfalls. Shebalin Technologies, Inc. (STI) has developed a design concept with the objective of meeting this challenge—the Thermoformed Projectile Cartridge (TPC) round 110, as shown in view 100.

The exemplary Thermoformed Projectile Cartridge (TPC) concept presented incorporates a metallic shell 230 and 240 which partially encases the propellant charge 260 and becomes the projectile 445 by thermoforming in the chamber of the barrel 416 upon firing—analogous to explosively formed penetrators. This projectile 455 is then streamlined by the tapered barrel 416, as with squeeze-bore projectiles. For maximum firing rate, this TPC round 110 would be fired by an electronic ignition system.

This exemplary cartridge concept incorporates the strengths and features of caseless cartridges, flechettes, EFP's, squeeze-bore projectiles, and electronic ignition to the simplest lightest and most compact cartridge possible while still delivering the required ballistics for a next generation service rifle. The result would be an essentially caseless cartridge with as little as 25% of the mass of conventional cartridges and 50% of the volume of conventional cartridges. This innovation expands ammunition capacities, and will facilitate increased hit probability through high-rate controlled bursts. The TPC round 110 represents a simultaneous fusing of several key principles.

The key design element of the TPC concept is the compact cartridge which is semi-encased by a shallow metal cup. This cup is formed into the projectile through the firing process by means of thermoforming within the specially shaped fluted chamber and further swaged by the tapered barrel 412. For durability and protection from weather and wear, the assembled TPC round 110 may be covered in a protective "shrink-wrap" coating that would burn away upon firing. The design of this TPC round 110 for service rifle applications would consist of a 15-grain charge which would propel a 30-grain projectile to an anticipated velocity of 1200 m/s to 1500 m/s.

Firing the TPC round 110 consists of five stages: ignition (second event 420), thermoforming (third event 430), acceleration (fourth event 440), swaging (fifth event 450), and stabilization (sixth event 460) in view 400:

1. Ignition 420: An electrical firing pin 418 penetrates the protective coating 240, igniting the primer charge 250.
2. Thermoforming 430: The detonation of the booster charge 250 drives the projectile into the entry chamber, forcing it into its initial conical shape 434.
3. Acceleration 440: The large diameter, low ballistic sectional density thermoformed projectile 445 accelerates along a straight, fluted section of the bore 416.
4. Swaging 450: The tapered mid-barrel bore 416 swages the projectile 455 down to a diameter as small as one fourth the cartridge's initial diameter.
5. Stabilization 460: The final portion of the barrel 412 is rifled to spin stabilize the projectile 465.

The exemplary TPC round 110 is designed to be ignited by means of an electronic ignition system, such as that used in the Voere Electronic Rifle, VEC-91. The reason for electronic ignition is primarily to enable higher firing rates. As such, the primer charge 250 may also serve as the booster to provide the initial thermoforming deformation, as shown in the second event 420.

Because of its flat shape, the TPC round 110 may be fed into the firing chamber through the slot 414 in the breech by means of a feed-and-extraction block (FEB), after which the chamber of the bore 416 is sealed by a locking sleeve. The shorter travel distances and lighter weight of the moving components, relative to comparable rifle actions, including that of H&K's G11, can reduce cycle time to yield firing rates in excess of the G11's 2200-rpm firing rate. In the event of a misfire, the FEB can extract unspent TPC round 110 and then driven to the rear of the FEB by an ejector rod before the FEB moves into position to receive a new cartridge from the magazine. The magazine itself would hold the TPC rounds 110 in a stacked configuration 310, highly suited to a top- or bottom-feeding magazine design which could be oriented lengthwise parallel to the barrel 412.

The greatest benefit of the exemplary TPC weapon system would achieve the previously unmet objectives pursued by Army R&D programs over the past fifty years by vastly increasing kill probability for the soldier. The TPC system would do so by providing cartridge technology suitable for a next generation service rifle with not only twice the hit probability of existing rifles and greatly increased ammunition capability, thus increasing an infantry soldier's overall firepower. Relatively speaking, such a TPC round 110 could serve as the central concept for a service rifle with a several-fold increase in firepower over the currently available M16 and its variants.

For the exemplary TPC round 110, minimal size and mass yields increased ammunition capacity: A key advantage of this exemplary concept is minimal size and mass. By eliminating the cartridge case, an immediate 48% mass reduction is realized over the 5.56×45 cartridge. A further reduction of 20% results from using a much lighter projectile. Finally, the converging barrel design results in an increase of 250% of the expansion ratio when compared to an equivalent existing 5.56×45 barrel. This, along with an increased propellant charge/projectile mass ratio, results in 43% less propellant used, yielding a 7% weight savings. The overall result would be a cartridge with only one-quarter the mass of the 5.56×45 cartridge for the same performance, thus facilitating vastly greater ammunition capacity.

Another potential advantage of the exemplary concept is the fact that the compact size and low-recoil would enable higher burst rates which, combined with the projectile's flat trajectory, could serve to increase hit probability as indicated in the SALVO, SPIW, and ACR programs. The result would be a rifle system meeting the operational requirements for a next-generation service rifle indicated in research programs over four decades.

Other benefits would include potential for line-of-site aiming, variable ballistics, and reduced logistical burdens. The potential for line-of-site aiming, over greater ranges, would result from the TPC's higher velocity and thus flatter trajectory. Significant variation in the TPC's ballistic properties-such as caliber, ballistic coefficients, and penetration—could be achieved by changing a tapered barrel attachment. This design would affect the constriction and stabilization steps of the TPC firing process. Finally, logistical burdens such as production, shipping, and storage costs may be reduced due to the exemplary design's simplicity, small size, and low mass.

To demonstrate the feasibility of the exemplary TPC concept, the following technical challenges must be overcome. These include sensitivity of proper, consistent thermoforming to chamber design; adequate sealing of the bore 416 by the deformable projectile to give proper ballistic performance; and adequate thermal dissipation. The initial efforts will investigate the feasibility of overcoming these potential challenges. Successful development of this concept can produce enormous increases in a soldier's available firepower. In addition this achievement would meet and exceed all of the goals of past rifle fire power improvement programs and studies.

A critical element of the TPC concept is the initial thermoforming of the cup encasing the propellant charge 260 so that it can be reliably accelerated through the barrel during the acceleration step of the firing process. Because this thermoforming is largely constrained and affected by the shape of the chamber and thermoforming portion of the barrel, it may be sensitive to imperfections in chamber and barrel geometry due to manufacturing variability and erosion. Thus, to demonstrate the TPC's feasibility in this respect, one must determine the level of this sensitivity and to develop a cartridge and barrel design such that performance is robust enough to be unaffected by potential chamber and barrel imperfections.

High velocity would be achieved by accelerating the large diameter, low mass projectile down the main barrel during the acceleration step of the TPC firing process. As with any rifle, this involves an effective seal between the bore 416 and the projectile 465. However, the irregular shape of the projectile 465 may present different challenges than that presented by the rifling "engraving" of a conventional bullet. Thus, to ensure the feasibility of the TPC concept, this sealing issue would be addressed by early testing of barrel 412 and cartridge designs proving the effectiveness of the seal of the bore 416 during firing.

To satisfy operational requirements, a TPC rifle should be able to fire fully automatic for at least 180 rounds without spontaneous "cook-off" due to barrel overheating. In typical rifles, the brass case absorbs and carries away much of the heat which might otherwise be absorbed by the chamber. However, this benefit is not present in caseless cartridges such as the TPC round 110 and although caseless propellants with up to 100° C. higher ignition temperature have been developed, overheating may become a problem in the TPC round 110 due to vastly increased ammunition capacities. Therefore, barrel heating should be investigated and, if necessary, methods to mitigate or eliminate barrel overheating tendencies should be developed.

The initial tasks in developing the exemplary concept will be to investigate its overall feasibility and to successfully demonstrate the thermoforming within the chamber of the TPC's projectile—the key to the TPC's operation. Successful completion of these tasks would be followed by the development of the complete TPC round 110, the feeding system, and overall rifle platform for firing the TPC round 110.

Phase I will focus on investigating the feasibility of the core concept, which is the thermally forming of the shallow metal cup case into a streamlined projectile by driving it through a specially shaped converging barrel. This will be done by specifically addressing the technical hurdles described on the previous page. The successful completion of Phase I expects to conclude with a proof-of-concept demonstration. This stage should require roughly 650-manhours of labor and $35,000 of materials for a total composite budget of roughly $100,000 over 9 months. The Phase I work plan will begin with investigations into the issues of consistent thermoforming, effective bore sealing, and overheating issues, including possible methods to ensure the TPC's feasibility with respect to these issues. The initial feasibility study will be followed by the development of a test barrel, hardware for producing the proof-of-concept projectiles, the projectiles themselves, and propellant charges for the proof-of-concept firings.

The prototype round for Phase I will only include the projectile casing, 0.5 mm to 1.0 mm thick, 8 mm to 10 mm thick, and 12 mm to 15 mm in diameter. This is more elongated than the design shown in view 100 to better ensure consistent thermoforming, while still demonstrating the entire TPC concept. By contrast, Phase II work reduces projectile diameters to 4 mm. The proof-of-concept round will be fired using a conventional blank 5.56×45 cartridge.

Phase II will focus on the TPC Cartridge, Barrel, & Ignition System. Following the successful demonstration of the TPC concept's overall feasibility, Phase II would focus on the design of a complete TPC cartridge, along with the barrel design ignition system for firing. This stage should require approximately 5000-manhours of labor and $250,000 of materials for a total composite budget of roughly $750,000 over 18 months.

The Phase II work plan would include using the proof-of-concept barrel and test setup from Phase I to fire a series of projectiles and to explore the effects of varying metal thickness and pressure profiles on the projectiles ballistic performance. This work would then involve refining the barrel design and repeating the iteration. Phase II will then involve developing and testing a working ignition system for the TPC ammunition and will be completed with test firings of the completed TPC through the refined barrel design using the newly developed ignition system.

Phase III would focus on developing the automatic feeding system for a TPC rifle and its integration with the barrel and ignition system to produce a prototype rifle. The first task would be to design the feed system, followed by the production of a prototype firing system, including the feeding system, barrel, and ignition system. This test assembly would be used to assess and refine the design to achieve desired firing rates and reliability. Finally, the improved test assembly design would be incorporated into a rifle platform. Judging by past development programs, such as Heckler and Koch's G11, Phase III may require a budget of up to $6 million over a period of at least two years.

This system would be commercialized after Phases II or III either through the sale or licensing of the technology to, or the creation of a joint venture with, an existing arms manufacturer. The market depth for the TPC rifle and cartridge alone is significant, based on examination of quantities for the current standard service rifle, the M16.

Over the past forty years, over four-million M16's and variants have been manufactured and sold, at a nominal cost of $600 each for a total cost of $2.4 billion. Each rifle was designed for tens of thousands of rounds of ammunition, at 15¢ per round, resulting in $12 billion in cartridge sales for the 5.56×45 cartridge. That suggests a market that is roughly $3 billion-per-year in sales for service rifles and their ammunition alone.

Although this concept summary has focused on the use of a TPC-based next generation service rifle, the uses of the TPC round 110 are not limited to this application. The TPC round 110 can be scaled up or down to serve in any application where extremely light mass and small size—and the resultantly large ammunition capacities—would be desirable. This may include anti-material rifles, aircraft cannons, anti-aircraft guns, and close in defense systems for ships and facilities, a role currently filled by the 20 mm Phalanx Close-In Weapon System (CIWS).

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An axisymmetric disk-shaped thermoformed projectile cartridge (TPC) and a gun, said TPC comprising:

a primer core that initiates in response to being struck;

a propellant charge that annularly envelopes said core separated by an annular gap;

a booster charge disposed over said propellant charge and within said annular gap, said booster charge initiating in response to said core, and said propellant charge initiating in response to said booster charge;

a projectile mass disposed over said booster charge;

an ablative cap disposed over said projectile mass; and a ductile metal coating that covers over said ablative cap, and around and under said propellant charge and said core, wherein said coating and said mass elongate and radially narrow to maintain axial symmetry while being accelerated along a fluted bore in the gun, said bore narrowing from a breech to a muzzle of the gun.

2. The thermoformed projectile cartridge according to claim 1, wherein the gun includes a firing pin adjacent to said breech, and said firing pin strikes said primer core for initiation.

3. The thermoformed projectile cartridge according to claim 1, having a thickness-to-diameter aspect ratio of about one-quarter.

4. The thermoformed projectile cartridge according to claim 1, wherein equivalent to 5.56×45 caliber, diameter is 2.06 cm, thickness is 0.5 cm, and total mass is 1.0 gram.

5. A gun having a fluted bore, said gun comprising:

a firing pin within the bore that narrows from a breech to a muzzle; and an axisymmetric disk-shaped thermoforming projectile cartridge (TPC) for discharging from the bore, said TPC lengthening and narrowing while traversing through the bore, said TPC comprising:

a primer core that initiates in response to being struck by said firing pin, a propellant charge that annularly envelopes said core separated by an annular gap, a booster charge disposed over said propellant charge and within said annular gap, said booster charge initiating in response to said core, and said propellant charge initiating in response to said booster charge, a projectile mass disposed over said booster charge, an ablative cap disposed over said projectile mass, and a ductile metal coating that covers over said ablative cap, and around and under said propellant charge and said core, wherein said coating and said mass elongate and radially narrow to maintain axial symmetry while being accelerated along the bore.

6. The gun according to claim 5, said gun loading said TPC laterally through said breech.

7. The gun according to claim 5, wherein equivalent to 5.56×45 caliber, said TPC has a diameter of 2.06 cm, thickness of 0.5 cm, and total mass of 1.0 gram.

8. The thermoformed projectile cartridge according to claim 2, wherein said coating further location an axial center nipple proximate to said primer core for engaging said firing pin.

* * * * *